US005438780A

United States Patent [19]

Winner

[11] Patent Number: 5,438,780

[45] Date of Patent: Aug. 8, 1995

[54] ROAD SIGN AND INFORMATION DISPLAY APPARATUS

[75] Inventor: Bengt Winner, Upplands Väsby, Sweden

[73] Assignee: ATA Bygg-och Markprodukter AB, Sundbyberg, Sweden

[21] Appl. No.: 966,073

[22] PCT Filed: Jul. 17, 1991

[86] PCT No.: PCT/SE91/00500

§ 371 Date: Mar. 11, 1993

§ 102(e) Date: Mar. 11, 1993

[87] PCT Pub. No.: WO92/01838

PCT Pub. Date: Feb. 6, 1992

[30] Foreign Application Priority Data

Jul. 17, 1990 [SE] Sweden ..... 9002448

[51] Int. Cl.[6] ..... G09F 11/18

[52] U.S. Cl. ..... 40/514; 40/591; 40/592; 40/601; 40/610

[58] Field of Search ..... 40/514, 591, 592, 601, 40/610, 612; 428/196

[56] References Cited

U.S. PATENT DOCUMENTS

| | | | |
|---|---|---|---|
| 1,467,937 | 9/1923 | Jarvis | 40/517 |
| 1,703,780 | 2/1929 | Radke | 40/517 |
| 3,430,374 | 3/1969 | Woodard | 40/591 |
| 3,590,506 | 7/1971 | Jeski | 40/610 |
| 3,761,890 | 9/1973 | Fritts et al. | 40/592 |
| 3,949,503 | 4/1976 | Waress | 40/591 |
| 4,817,318 | 4/1989 | Strauch | 40/612 |

FOREIGN PATENT DOCUMENTS

| | | | |
|---|---|---|---|
| 106629 | 4/1984 | European Pat. Off. | 40/591 |
| 0412281A1 | 2/1991 | European Pat. Off. . | |
| 1312374 | 11/1962 | France . | |
| 674225 | 4/1939 | Germany | 40/517 |
| 2543232A1 | 4/1977 | Germany . | |
| 2054234A | 2/1981 | United Kingdom . | |

*Primary Examiner*—Kenneth J. Dorner
*Assistant Examiner*—Cassandra Davis
*Attorney, Agent, or Firm*—Armstrong, Westerman, Hattori, McLeland & Naughton

[57] ABSTRACT

A road sign having a message displayed on a soft reflective plastics material which is attached to a net fabric, preferable a PVC plastics. The net material is attached to a frame structure including a first bar connected at one end of the net and a second bar connected at an opposite end of the net. The net is wound around a roller proximate one of the bars. The bars are biased apart by spring biased folding arms. The device thereby can be raised to an open position by the spring force. Further, a hand crank, or a motor, and also a remote control, can be included for manipulation of the sign, such as to a closed position.

1 Claim, 5 Drawing Sheets

ROAD SIGN AND INFORMATION DISPLAY APPARATUS

The present invention relates to a road sign and information display apparatus.

Setting up as well as changing road signs and information displays made from metal sheeting is laborious, which is a large drawback in the temporary use of signs, or changes of them, as well as setting up other information messages of temporary nature for road users.

The object of the present invention is to achieve a road sign and/or information display apparatus which can be rapidly and easily placed in position and removed.

This object is achieved with a road sign and information display apparatus in accordance with claim 1.

In providing signs for road works, for example, the road sign message may be readily unrolled, and after termination of the work period once again wound up on its roller. In this way the road sign or information display is protected from becoming dirty, so that it will remain just as clean the next time it is used as it was when it was rolled up. A road sign in accordance with the prior art that has been opened out during a weekend, for example, is however dirtier the next time it is to be used, and may also be covered with snow and ice, if the weather conditions are such.

Temporarily covering and uncovering signs is also a large and expensive task, which is considerably simplified by the inventive apparatus. Since the road sign and information display apparatus can be placed close to a road sign displaying an erroneous message, the screen with the correct information can obscure the former when the screen is rolled out.

In accordance with an advantageous further development of the apparatus in accordance with the invention, the stand carrying the roller is formed such as to be carried by a car or other vehicle, by special a trailer or as to also be stationarily installed. The stand can thus be formed for mounting on an ordinary car roof rack, and by unrolling the screen road users are warned in a simple manner of conditions such as road works in progress and/or informed what side of the vehicle they shall pass. Further, if the roller is motor driven and adapted for operation from inside the vehicle, the screen can be rolled out while the vehicle is moving, i. e. road users can be informed before the working vehicle has stopped. To advantage, the stand can also be formed for mounting on the tailgate of a lorry, a special road sign carrier then not being needed. However, if a special carrier is used, it can be made much less voluminous for the road sign and information display apparatus according to the invention than a conventional road sign carrier. On the same area as required for a conventional carrier, there is room for four cassette trailers made for the apparatus according to the invention, e. g. when they are placed on a lorry deck for transport.

According to a further advantageous embodiment of the apparatus according to the invention, the stand is collapsible, preferably by making it with spring biased folding arms or telescopic arms for correctly unrolling the screen carrying the display. Transport of the road sign or information display apparatus is facilitated by such collapsibility.

If a motor driven roller is used, this can be remotedly controlled in another advantageous embodiment of the apparatus according to the invention, thus enabling a temporary message to be displayed without somebody having to visit the site of the apparatus to operate it. If the message is to be displayed at regular intervals during the day, for example for a certain time of the day, this can be controlled automatically with the aid of e. g. a computer.

According to a still further advantageous embodiment of the apparatus according to the invention, the road sign and information message is arranged on soft, reflective plastics material attached to a net fabric. There is thus obtained visibility through the screen at the sides of the actual displayed information, which is an important advantage from the traffic safety aspect and in addition air can pass through the net, i.e. wind effect on the apparatus will be reduced.

Embodiments of the apparatus according to the invention, selected as examples, will now be described in more detail, and with reference to the accompanying drawings, where:

Figure 1:
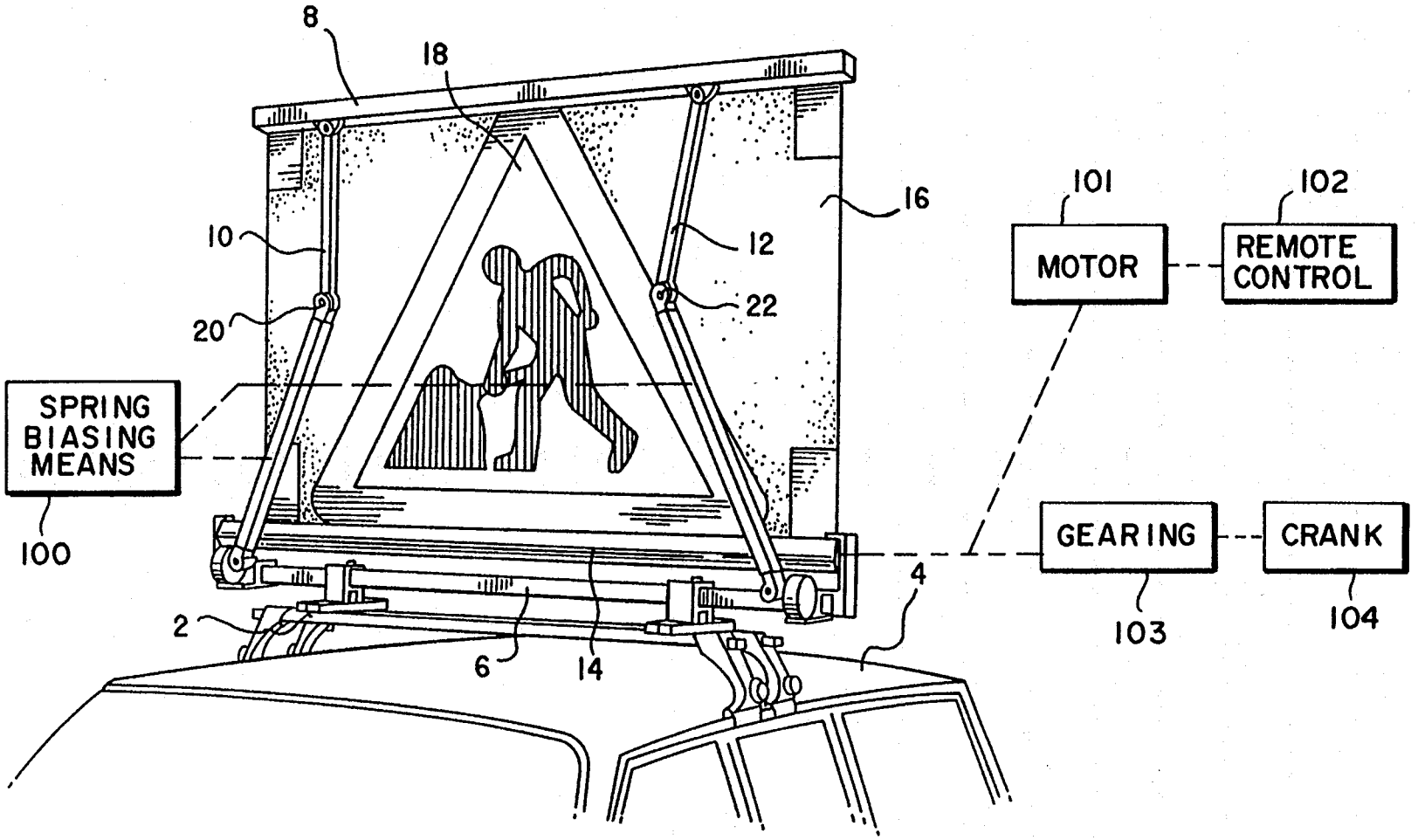
FIG. 1 illustrates a first embodiment of the apparatus according to the invention, provided with a stand having folding arms.

FIG. 1 illustrates an embodiment of the apparatus according to the invention, with the stand mounted on the roof rack 2 of a car 4. The stand includes a bar 6, fastened to the, rack 2 and a, second bar 8 parallel to the bar 6, said bars being interconnected by spring biased via spring biasing means 100, folding arms 10, 12.

A roller 14 is attached to the bar 6, and a screen 16, of soft material can be rolled up on the roller, which screen carries a road sign or other information. The free edge of the screen 16 is attached to the bar 8, thus enabling it to be unrolled from the roller to display the road sign 18 as the folding arms are straightened.

The screen 16 can be wound up on the roller for obliterating the road sign 18, the stand collapsing at the same time as the arms 10, 12 are folded about the joints 20, 22. In the embodiment illustrated in FIG. 1, the screen is wounded manually on the roller, simply by rolling the screen by a, not shown, crank 104 connected to the roller, and optionally via gearing 103, in order to facilitate cranking.

The roller may however also be motor driven, and in such a case the motor can be controlled from the interior of the vehicle via a rentate control 102, so that the screen 16 with its message 18 is unrolled while the vehicle is still moving such that the message is completely displayed when the vehicle has reached the display site.

An advantage with the apparatus according to the invention is that the screen, with its road sign and/or information message, is protected from dirt in its rolled-up state.

The screen 16 includes a net fabric, preferably of PVC plastics, on which the sign itself, of reflective, soft, self-adhesive, plastics material, is mounted. This embodiment has the advantage that there is a visibility through the screen outside the actual sign 18, which is an advantage from the safety aspect and in addition thereto the apparatus will be less sensitive to wind when the screen is rolled out, since air can pass through the net at the sides of the sign 18. By forming the folding arms with strong springs, the screen 16 can be kept upright at vehicle speeds of up to 70 km/h.

Figure 2:
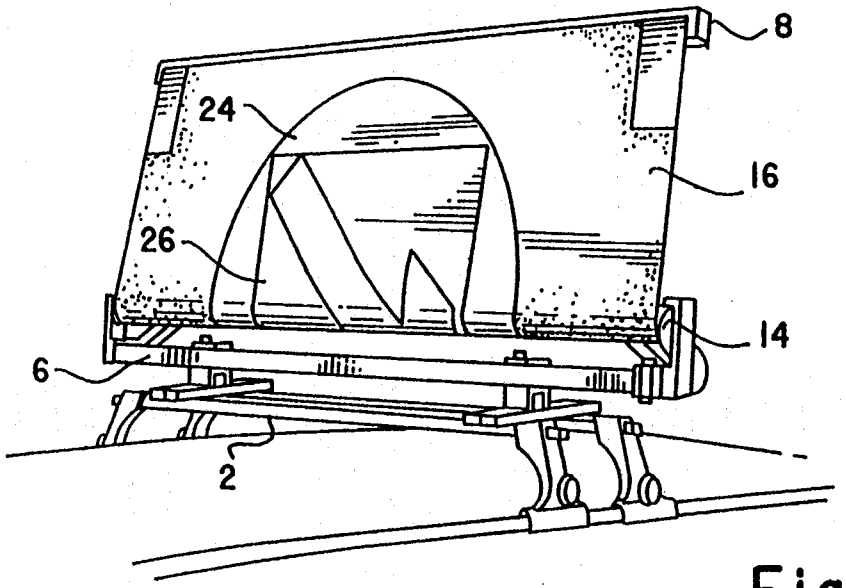
FIGS. 2 and 3 show the same embodiment example from the front, with road sign screen half rolled out and fully unrolled, respectively.
Figure 3:
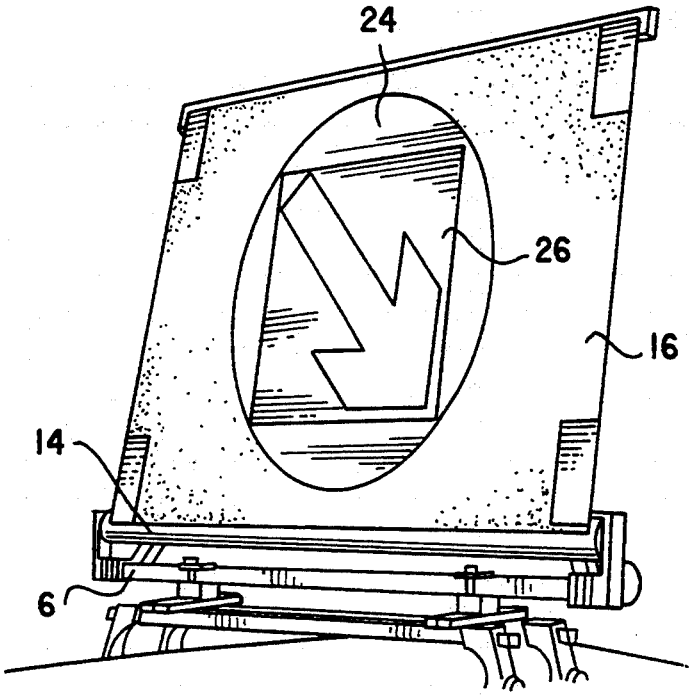

In FIGS. 2 and 3 the embodiment of FIG. 1 shown from the opposite side to that in FIG. 1, with a screen carrying another sign. The apparatus is shown during rolling up in FIG. 2, while in FIG. 3 it is in the working position with the screen fully extended.

In the embodiment of FIGS. 2 and 3, the arrow forming the central portion 26 of the sign 24 is disposed in a cut-out state, so that it can be peeled off from the screen 16 and replaced so that the arrow points in another direction. This means that the sign 24 can easily be modified as required, using the method indicated.

Signs or other information may also be disposed on either side of the screen.

Figure 4:
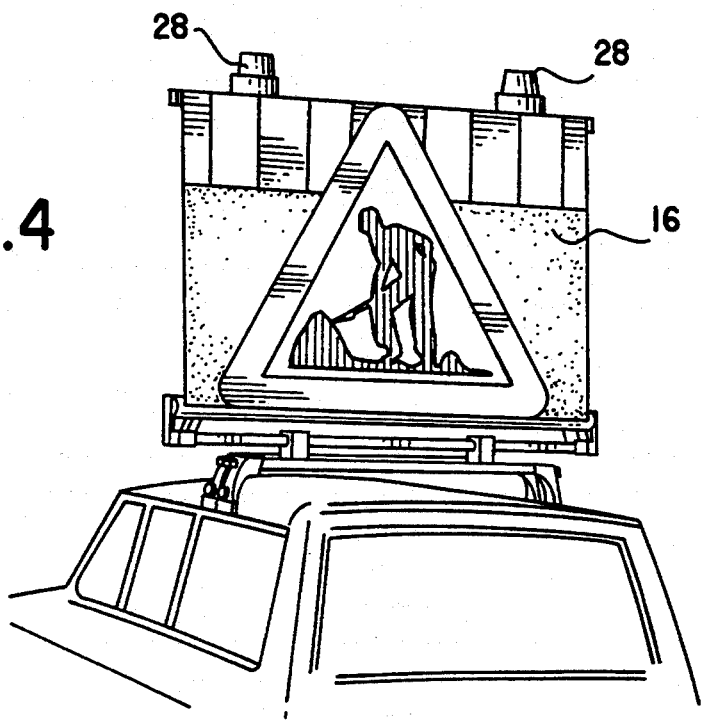
FIG. 4 shows the example of FIGS. 1–3 provided with warning lights.

In FIG. 4 there is illustrated an embodiment with warning lights 28 mounted at the top of the stand. These warning lights 28 may suitably be connected such that they illuminate at the same time as an electric motor is started for unrolling the screen 16.

Figure 5:
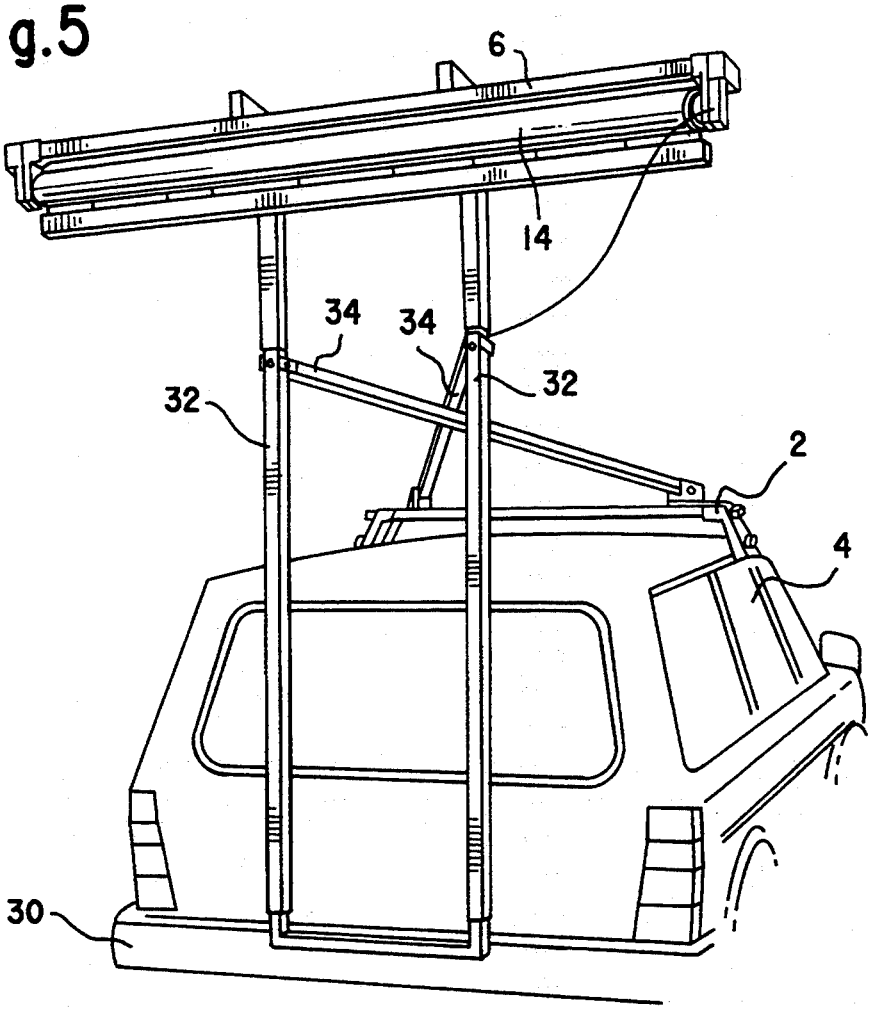
FIGS. 5 and 6 illustrate an embodiment intended for mounting on a car rear bumper, the road sign screen being rolled up and unrolled respectively.
Figure 6:
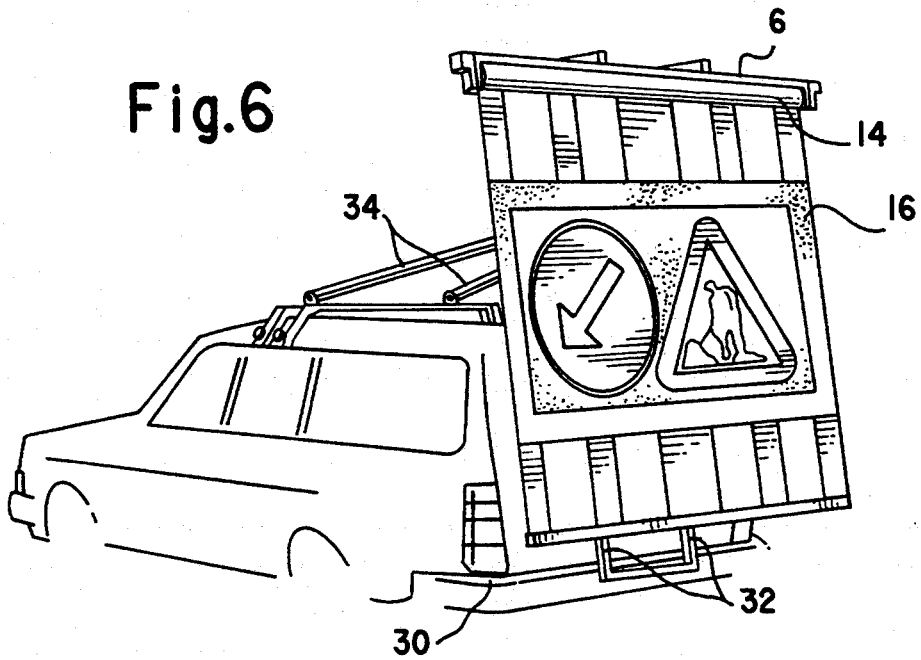

In FIGS. 5 and 6 an embodiment is illustrated intended for mounting on the rear bumper of a car 4. The stand here includes two vertical, telescopic bars 32, to the upper ends of which the bar 6 with its roller 14 is attached for rolling down the screen 16 and its message, see FIG. 6. The bars 32 are braced via braces 34 against the roof rack 2 of the vehicle.

Also in the embodiment of FIGS. 5 and 6, the roller 14 is to advantage motor driven, and controllable from the interior of the vehicle, for rolling out the message, when needed, while the vehicle 4 is moving.

The bars 32 are preferably telescopic, i.e. their upper and lower portions are displaceable, one within the other, for regulating the total height of the stand, the portions of the bars can be mutually fixed in optional positions with the aid of locking wheels on the bars (not shown).

Figure 7:
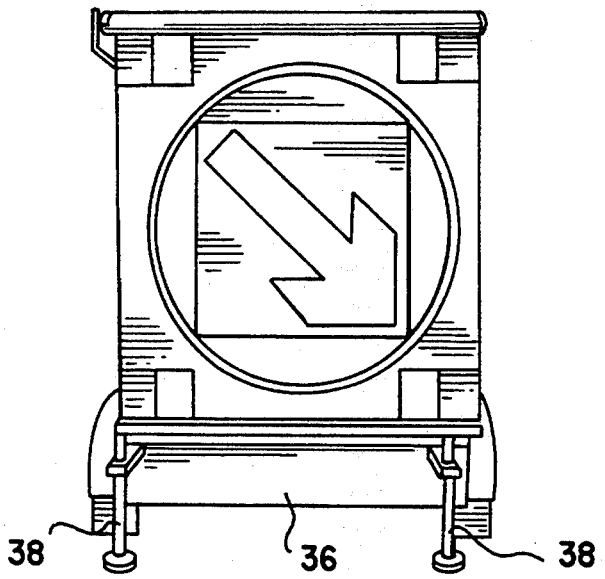
FIG. 7 illustrates a further embodiment of a special road sign trailer.

In FIG. 7 there is illustrated an embodiment of the apparatus according to the invention, mounted on a special trailer 36, which can be taken to the intended site of the message. When set up, the trailer 36 suitably rests on three supporting legs, of which the two rear ones 38 are extendable, thus providing very good stability against heavy winds. In this case as well, the stand includes telescopic arms, which are retracted maximally when transporting the apparatus.

The trailer 36 can typically be 2 m long and 2 m wide, thus taking much less space than a conventional road sign trailer, e.g. during storage or transport of several trailers. Four trailers 36 can be accomodated on the same area in storage, or on the deck of a lorry as one conventional trailer.

Since the road sign is not "folded down" when it is taken out of use, as for conventional road sign trailers, but is rolled up, the problem of broken rear lights on the towing vehicle is eliminated which often occurs with conventional apparatus.

Warning lights are readily arranged on the apparatus in this embodiment as well. The trailer 36 may be provided with a power point for connecting such warning lights and for optional tandem connection of several trailers.

The apparatus according to the invention may also to advantage be mounted on the tailgate of a lorry or so-called "sky-lift" vehicle for warning road users, and increasing the protection of persons working at such vehicles.

Figure 8:
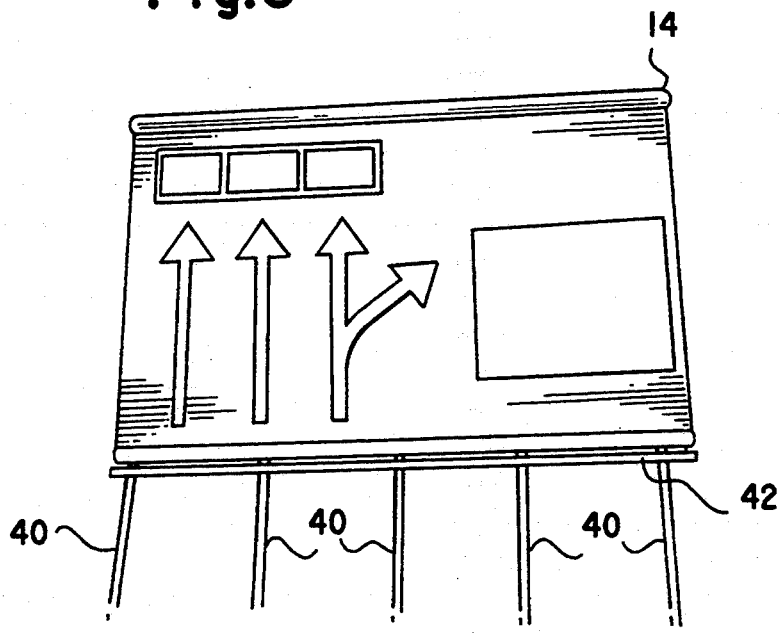
FIG. 8 illustrates a fixed set-up of the apparatus according to the invention.

In FIG. 8 there is illustrated a fixed installation of the apparatus according to the invention. In this case, the stand includes a plurality of vertical, braced members 40, at the upper ends of which the roller 14 is carried. The screen 16 with its information message is rolled out from the roller and attached at its free end to a horizontal bar 42.

Fixed installations may be remotedly controlled, such that the message is automatically displayed at a given time or times during the day, using a suitable control means, e.g. a computer or timer.

As mentioned above, signs or other messages may be mounted on one or both sides of the screen. However, it is conceivable to have two screens that can be unrolled, one on either side of the stand, and from their individually rollers or from a common one. The messages are then disposed on the sides of the screens facing away from each other, so that they are seen from both directions of the road.

I claim:

1. An information display apparatus, comprising:

an elongated roller;

a screen of soft material that can be wound up on said roller attached at one side of the screen to said roller;

a bar attached to said screen on a second side of said screen opposite to said roller;

at least one folding arm connected between said bar and a member which is fixed adjacent to and relative to said roller;

a spring-biasing means for extending said at least one folding arm and, thereby, separating said bar from said roller such that said screen is unwound from said roller to a fully-extended position solely by the force of said spring-biasing means;

means for rotating said roller such that said screen is wound around said roller and said bar is moved towards said roller against the direction of the bias of said spring-biasing means;

further including means for attaching said apparatus to a roof rack of a vehicle;

wherein said screen is formed out of a net fabric having sufficiently-sized holes therethrough that there is a visibility through the screen and such that air can readily pass through said screen, even when said screen is attached to a vehicle and driven in road use;

wherein said apparatus includes at least one warning light mounted thereon; and wherein said warning lights are mounted on said bar and said bar is at a position substantially vertically above said roller.

* * * * *